US009504323B1

(12) United States Patent
Porreca

(10) Patent No.: US 9,504,323 B1
(45) Date of Patent: Nov. 29, 2016

(54) DRAWER SLIDE STRUCTURE

(71) Applicant: Fedele Anthony Porreca, Henderson, NV (US)

(72) Inventor: Fedele Anthony Porreca, Henderson, NV (US)

( * ) Notice: Subject to any disclaimer, the term of this patent is extended or adjusted under 35 U.S.C. 154(b) by 736 days.

(21) Appl. No.: 13/694,688

(22) Filed: Dec. 20, 2012

(51) Int. Cl.
*A47B 88/00* (2006.01)
*A47B 88/04* (2006.01)

(52) U.S. Cl.
CPC ..... *A47B 88/0407* (2013.01)

(58) Field of Classification Search
CPC ..... A47B 88/0407
USPC ..... 312/263, 265.5, 265.6, 350, 334.4, 312/334.5, 334.7, 334.6, 334.14–334.15
See application file for complete search history.

(56) References Cited

U.S. PATENT DOCUMENTS

| | | | | |
|---|---|---|---|---|
| 678,125 | A * | 7/1901 | Paulle | 248/243 |
| 2,704,699 | A * | 3/1955 | Evans | 312/334.7 |
| 3,181,922 | A * | 5/1965 | McBean | 312/234.1 |
| 3,268,195 | A * | 8/1966 | Hoffman | 248/220.31 |
| 3,272,581 | A * | 9/1966 | Stucki | 312/234.4 |
| 3,677,615 | A * | 7/1972 | Hudson | 384/20 |
| 4,147,393 | A * | 4/1979 | Nelson et al. | 384/22 |
| 4,193,649 | A * | 3/1980 | Sharon | 384/19 |
| 4,440,461 | A * | 4/1984 | Powell et al. | 312/334.8 |
| 5,378,057 | A * | 1/1995 | Bach et al. | 312/257.1 |
| 5,470,144 | A * | 11/1995 | Wen | 312/334.13 |
| 5,496,105 | A * | 3/1996 | Czarnecky et al. | 312/334.4 |
| 5,632,542 | A * | 5/1997 | Krivec | 312/334.7 |
| 5,906,422 | A * | 5/1999 | Golias, Sr. | 312/334.7 |
| 5,927,838 | A * | 7/1999 | Hellman, Jr. | 312/257.1 |
| 6,036,291 | A * | 3/2000 | Rock | 312/333 |
| 6,270,281 | B1 * | 8/2001 | Ruusuvuori | 403/11 |
| 6,428,128 | B1 * | 8/2002 | Henriott et al. | 312/334.12 |
| 6,431,668 | B1 * | 8/2002 | Reddicliffe | 312/334.5 |
| 6,619,772 | B2 * | 9/2003 | Dierbeck | 312/334.13 |
| 6,788,997 | B1 * | 9/2004 | Frederick | 700/236 |
| 7,455,374 | B2 * | 11/2008 | Nachbaur et al. | 312/330.1 |
| 8,449,051 | B2 * | 5/2013 | Lam et al. | 312/333 |

(Continued)

FOREIGN PATENT DOCUMENTS

JP 04354903 A * 12/1992 ..... A47B 77/08

*Primary Examiner* — Hanh V Tran
(74) *Attorney, Agent, or Firm* — Jack C. Munro

(57) ABSTRACT

A drawer slide structure to be mounted within storage cavity of a cabinet which utilizes a pair of opposing grid panels mounted on sidewalls of the storage cavity. Each grid panel includes a plurality of identical slots arranged in two spaced apart columns of vertically spaced apart slots. The structure also includes a pair of opposing drawer slide mechanisms. Each drawer slide mechanism has a cabinet member for affixation to a grid panel and a drawer member for supporting a drawer. In each drawer slide mechanism the drawer member is slideably longitudinally movable relative to the cabinet member. The drawer and drawer member utilize an interlocking arrangement for fixing the drawer to the drawer member. The cabinet member includes a pair of outwardly extending hanger tabs with each hanger tab to engage with a slot for supporting the drawer on the grid panel. The drawer can be easily and quickly adjusted to connect with different slots so as to change the height of the drawer storage cavity which is located above the drawer. This invention also includes the method of installing a drawer within a storage compartment of a cabinet in just a few seconds without tools or experience.

9 Claims, 8 Drawing Sheets

(56) References Cited

U.S. PATENT DOCUMENTS

2001/0035704 A1* 11/2001 Dierbeck ..... 312/902
2003/0111941 A1* 6/2003 Noel et al. ..... 312/334.4
2004/0100169 A1* 5/2004 Huber et al. ..... 312/319.5
2005/0052102 A1* 3/2005 Lauchner ..... 312/334.5
2005/0184630 A1* 8/2005 Bonanno et al. ..... 312/408
2007/0222348 A1* 9/2007 Kobayashi ..... 312/334.6
2008/0164387 A1* 7/2008 Porreca et al. ..... 248/205.1
2009/0261700 A1* 10/2009 Chen et al. ..... 312/334.46

* cited by examiner

DRAWER SLIDE STRUCTURE

REFERENCE TO PRIOR APPLICATION

This application is a continuation-in-part of U.S. non-provisional application Ser. No. 12/776,119, entitled ADJUSTABLE DRAWER SLIDE SYSTEM, by the present inventor.

BACKGROUND OF THE INVENTION

The field of this invention generally relates to an apparatus and method for slideably mounting drawers in cabinets. More particularly, the present disclosure relates to a drawer slide structure and method of installing same within a storage compartment of a cabinet.

Cabinets can take numerous forms such as a piece of furniture, a wall or floor mounted structure and even a refrigerator. Drawers and trays are normally found in cabinets that are commonly found in kitchens, bathrooms and utility rooms of houses or in offices of commercial establishments. A tray is just a shallow drawer. Each drawer or tray includes a storage area located above its bottom surface defined as a storage compartment cavity. Drawers are a convenient means by which a person can access the contents supported by the drawer. The drawer is pulled outward from the cabinet so that its contents are easily perused and objects readily removed or replaced.

Most older or inexpensive pieces of furniture and cabinets use wooden sliders upon which the drawer slides as it is opened or closed. Newer furniture and cabinets may use plastic lower friction slides and more elaborate slide structures that incorporate ball bearings which will provide for smoother operation. Modern drawer slide structures are usually categorized in how such are mounted, including center mount, side mount, bottom mount and European mount. Drawer slide structures are intended for use varying from light to heavy drawers and thus contain load ratings from 75 to 450 ponds. A load rating of 100 pounds is considered typical.

Many cabinets have their storage compartments accessible through doors. These compartments traditionally have been subdivided by shelves. It has been common to locate the shelves vertically spaced apart at fixed distances apart. Later applications have included making the shelves vertically adjustable permitting the user to customize the storage cavity sizes of the shelves. If a drawer or tray is included with the shelves, such are commonly glide mounted. This mounting of the drawer or tray allows such to be extended out of the storage compartment so the contents contained by the drawer or tray to be easily accessed in lieu of the user having to bend down and reach into the cabinet or having to get on one's knees to gain access to the rear of the drawer or tray.

Cabinets having drawers with defined dimensions can be constructed in an off site installation such as in a factory. In the off site cabinet construction the drawers must be precisely constructed. Measurements must be exact. If not exact, at the installation site the drawers can not be installed requiring modification back at the factory which is time consuming. In the case of custom made cabinetry the drawers can be permanently mounted on site of the installation. Once the slide structure of prior art installations for a drawer is established there has not been any adjustment provision included. However, in the case of cabinets having a door that opens to a single storage cavity with one or more pull out shelves, drawers or trays the user may desire to have the shelf, drawer or tray to be height adjustable to tailor the storage space for the particular items to be stored therein. For example, a collection of plastic storage containers may not need as much clearance as a set of metal pots and pans and the user may wish to adjust the height of the various shelves, drawers or trays to optimize the storage efficiency. In the past drawer slide structures have been permanently installed using fasteners (screws, nails or bolts) not permitting adjustability of the drawers. Because of the difficulty of mounting drawer slide structures, users of cabinetry have been limited to a choice of vertically adjustable stationary shelves, drawers or trays positioned at fixed heights within the cabinet storage compartment. Therefore, a drawer, shelf or tray slide structure is needed whereby the drawer, shelf or tray is vertically adjustable within a cabinet compartment.

SUMMARY OF THE INVENTION

This invention is directed to a structure for mounting a drawer in a storage cavity of a cabinet. This structure is to be mounted in conjunction with the cabinet without using any tools. A grid panel is to be mounted using double sided tape to each sidewall of the cabinet. Each grid panel includes a pair of spaced apart columns of slots with these slots being identical and spaced apart. Typically each slot will have a width of about one inch and a height of about one-eight of an inch.

A drawer slide structure is to connect with each grid panel. Each drawer slide structure includes a drawer member and a cabinet member which are longitudinally movable relative to each other. The drawer member includes a shelf on which the drawer is to be supported. The cabinet member includes a pair of hanger tabs with each hanger tab to be inserted within a slot. Preferably each hanger tab has a plate configuration. Each hanger tab has a concave top surface. When inserted in and engaged with a slot the hanger tab establishes a pair of interference fits with the slot, one interference fit with the lower surface of the slot and the other interference fit with the upper surface of the slot. Preferably the length of the hanger tab will exceed the depth of the slot. The drawer slide structure can connect with any horizontal series of four in number of slots to achieve adjustment of the drawer so the height of the drawer storage cavity can be varied. The hanger tabs can be fixed as by welding to the cabinet member or the hanger tabs can be integral with a bracket that can be snapped onto the cabinet member. This invention also includes the method of installing the inventive structure within a storage cabinet.

The shelf includes a cut-out notch in the cabinet member of the slide. The drawer has a pair of laterally spaced apart descending tabs with each descending tab to interlock with a cut-out notch formed within a shelf of a drawer slide structure to lock together the drawer and the drawer members. The traditional method of engaging the drawer with the slide mechanism is different than in the present invention. There is no shelf with a cut-out notch making engagement and disengagement very difficult thereby discouraging height adjustment of the drawer.

One of the primary advantages of this invention is to provide a simple tool free installation of a drawer slide structure into an existing cabinet.

Another primary advantage of this invention is to permit the user to easily and quickly change the height of the drawer storage space within a cabinet.

Another primary advantage of this invention is to provide a quick and easy installation of a drawer with the drawer slide structure used in a storage cabinet.

Another primary advantage of this invention is to eliminate the use of fasteners (screws, nails and bolts) when installing of a drawer slide structure in a cabinet.

Another primary advantage of this invention is to provide a twenty times faster installation procedure of a drawer slide structure in a cabinet when compared to prior art installations using fasteners.

Another primary advantage of this invention is to achieve a drawer slide structure installation which requires no installation experience by the installer or not needing any measuring or leveling.

Another primary advantage of this invention is to utilize a drawer mounting structure which can be applied to a drawer of any design.

DETAILED DESCRIPTION OF THE INVENTION

Figure 1:
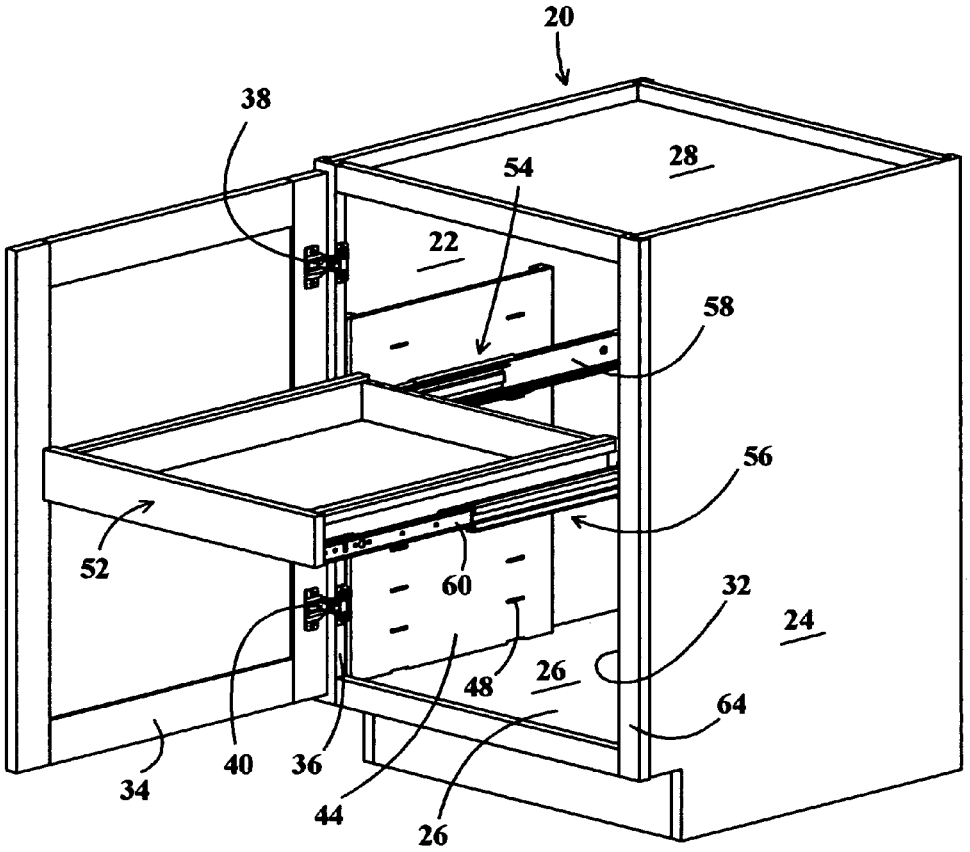
FIG. 1 is an isometric view of a storage cabinet which is shown with its door open within which is mounted the drawer slide structure of this invention showing the upper surface of the drawer and the drawer extended from the cabinet.
Figure 2:
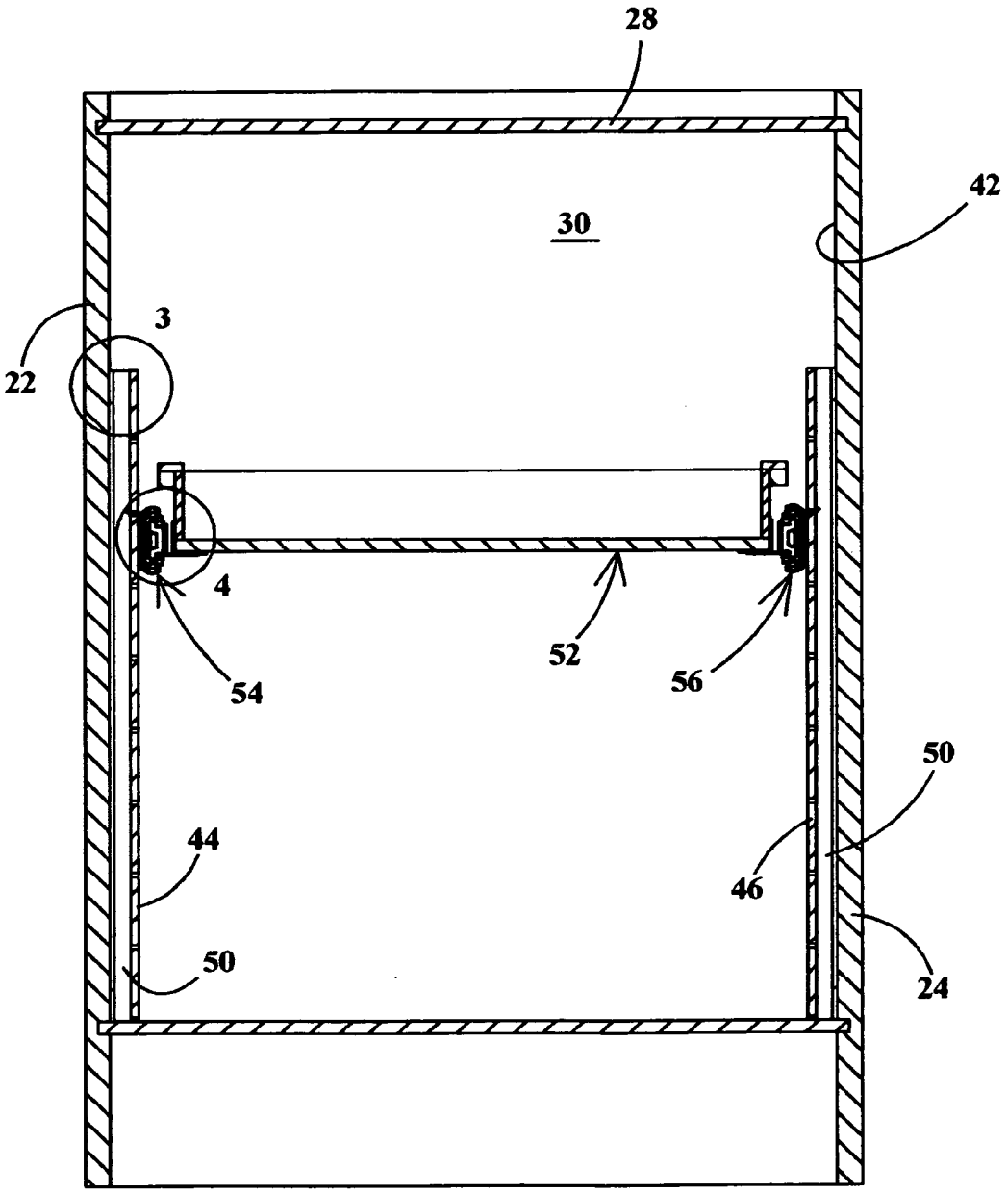
FIG. 2 is a transverse cross-sectional view of the storage cabinet of FIG. 1.
Figure 3:
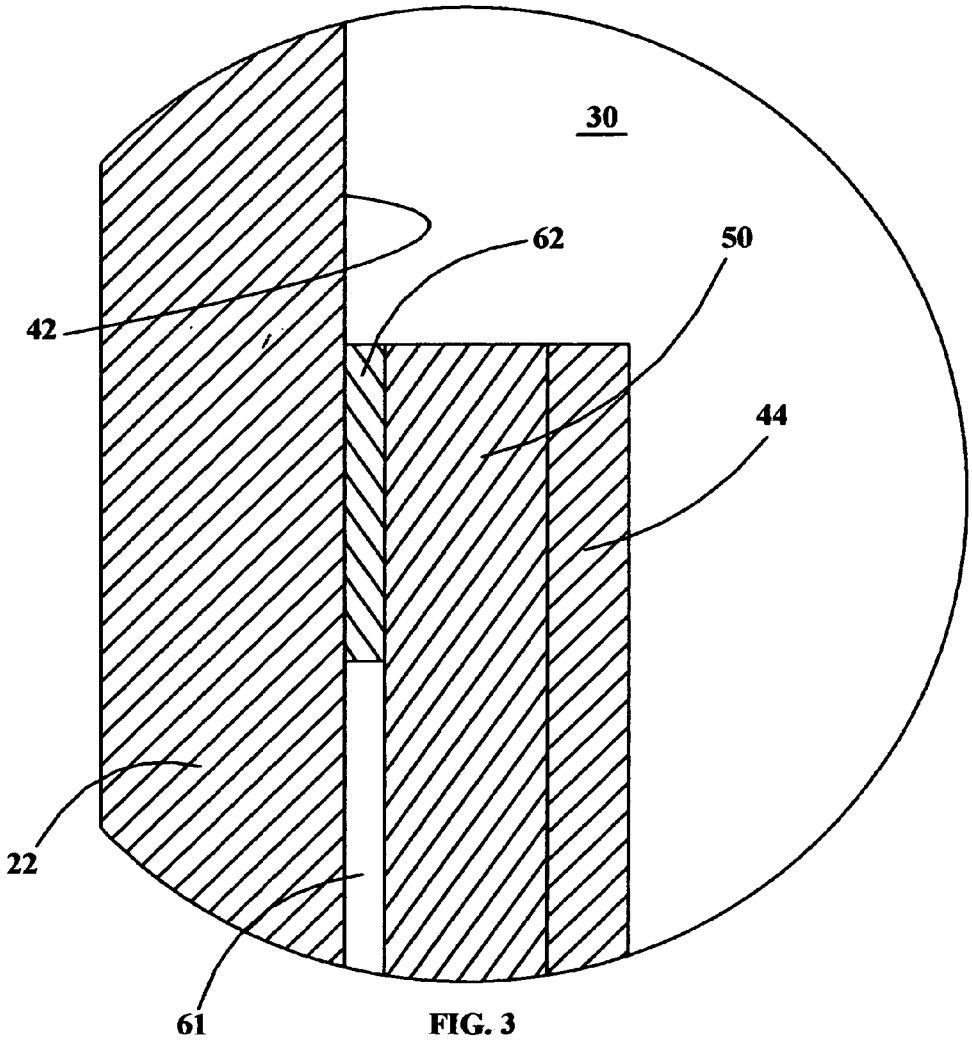
FIG. 3 is an enlarged cross-sectional view of the upper edge of the grid panel taken in the area 3 shown in FIG. 1.

The terms upper, lower, left, right, front, rear, outward, inward vertical and horizontal are to be taken in context with this invention as oriented in FIG. 1. Dimensions disclosed in this specification are not to be limiting unless the dimensions are claimed.

Referring specifically to the drawings, there is shown a cabinet 20 having a left sidewall 22, a right sidewall 24, bottom wall 26 and top wall 28. There is also a back wall 30 shown only in FIGS. 2, 3, 5, 7 and 9. The cabinet 20 has a front opening 32 which can be closed by a door 34 which is mounted on stile 36 by hinges 38 and 40. The door 34 can be opened to provide access into a storage compartment 42 or closed not providing access. It is to be understood that articles (not shown) are to be stored in storage compartment 42.

Located against sidewall 22 is a grid panel 44 which is formed of a sheet material which could be wood or composite material such as a pressed wood material. A metal or plastic could also be used. Also, the cabinet 20 could be any material of construction such as wood, metal, plastic or wood composites. All the walls of the cabinet are sheet material. There is an identical grid panel 46 located adjacent right sidewall 24 which is only shown in FIG. 2. Grid panels 44 and 46 include a pair of columns of slots 48 known as a front column (nearest door 34) and a rear column located aft of the front column. The slots 48 are all evenly spaced apart height wise in each column although such is not mandatory. But the slot arrangement between columns must be the same. Also the slots 48 must be horizontal. This means that a particular slot 48 in the front column has corresponding slot 48 in the rear column which aligns horizontally. Also, each horizontal pair of slots 48 in grid panel 44 align vertically with a corresponding pair of slots 48 in grid panel 46.

Fixedly mounted against the outer wall surface of grid panel 44 are a pair of spacer strips 50. One spacer strip 50 is located adjacent the front edge of grid panel 44 and another spacer strip is located adjacent the front edge of grid panel 46. Another spacer strip 50 is located adjacent the rear edge of grid panels 44 and 46. The primary purpose of the spacer strips 50 is to bring the grid panels 44 and 46 inwardly so the drawer 52 will move freely into and out of storage compartment 42 and not be restricted by door 34 or the border surrounding front opening 32. Also it is desirable to have a small space outward of the grid panels 44 and 46 as will be explained further on in the specification.

Mounted at the corner of each spacer strip 50 is a small square shaped pad of double sided tape 62. Normally these pads 62 are about one eight of an inch in thickness. The spacer strips 50 can be any desired thickness with generally one quarter of an inch to one inch being used. Double sided tape is define as tape which is constructed of foam which has an adhesive on both its outer surface and its inner surface. A release paper is to cover both of these surfaces until application is required. A desirable type of double sided tape would be a tape that is manufactured by 3M Corporation, part number 4959, thickness 120 mil, defined as VHB for very high bond. There are four in number of pads 62 for each grid panel 44 and 46. The outer release papers on the pads 62 are to be removed and the grid panel 44 is pressed against left sidewall 22 and grid panel 46 is pressed against right sidewall 24. The location is where the grid panel 44 is located just inside of stile 36 and grid panel 46 is located just inside of stile 64. Stiles 36 and 64 are located parallel to each other. The strength of the double sided tape pads 62 is such that it would be very difficult to remove either grid panel 44 and 46 once installed.

Associated with grid panel 44 is a drawer slide mechanism 54. A similar drawer slide mechanism 56 is associated with grid panel 46. The drawer slide mechanisms 54 and 56 are lineal in configuration and are mirror images of each other. Both of the mechanisms 54 and 56 have an outer member defined as a cabinet member 58 and an inner member defined as a drawer member 60. Located between cabinet member 58 and drawer member 60 is a center member 66. Located between cabinet member 58 and center member 66 are a series of balls 68, usually constructed of metal. There are an upper series of balls 68 and a lower series of balls. Upper series of balls 68 are arranged in a lineal row which is also true for the lower series. A retainer 70 is used to hold balls 68 in position. Located between drawer member 60 and center member 66 are a series of balls 72 which are held in place by retainer 74. There are also an upper series of balls 72 and a lower series of balls 72. The balls 68 and 72 permit low frictional movement of drawer member 60 relative to cabinet member 58. The function of retainers 70 and 74 are to keep the balls 68 and 72 in place respectively.

Figure 4:
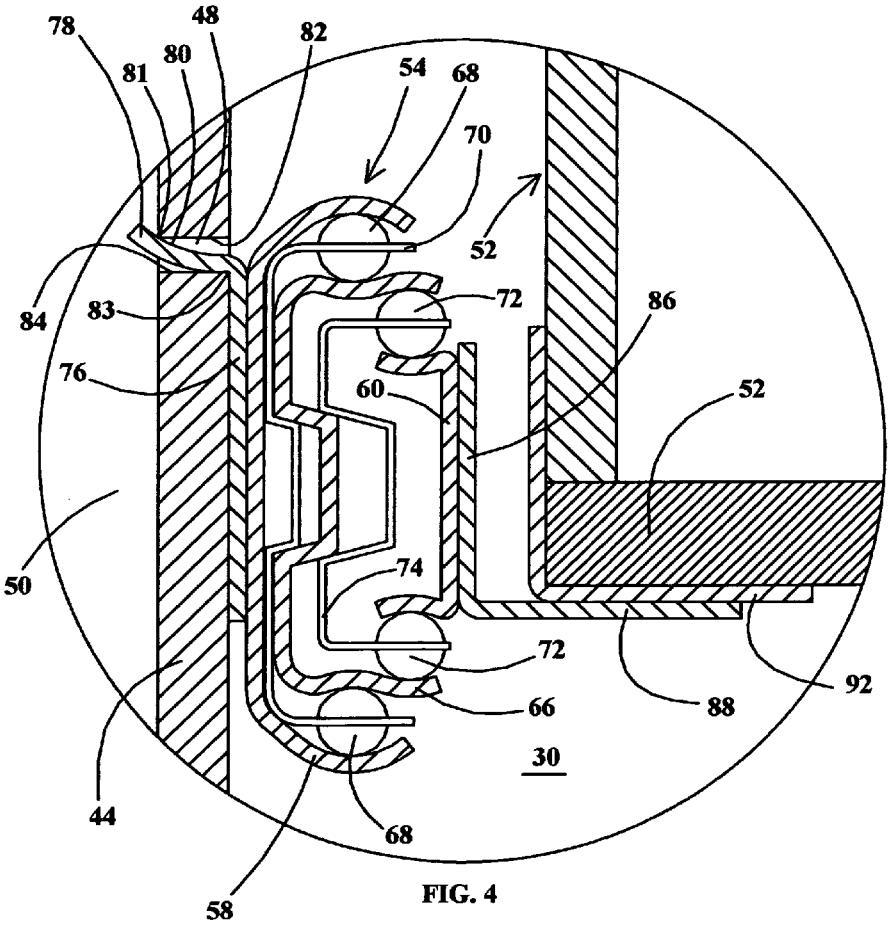
FIG. 4 is an enlarged cross-sectional view of the drawer slide of this invention taken in area 4 of FIG. 1.
Figure 5:
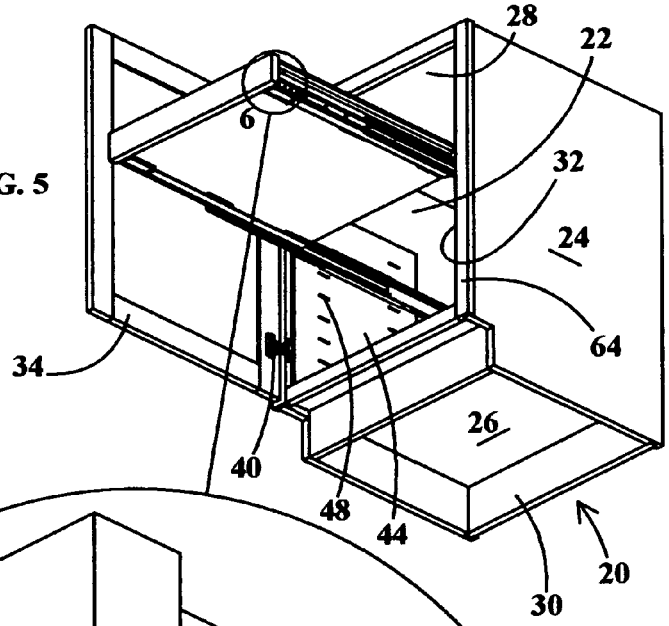
FIG. 5 is an isometric view of the cabinet within which is mounted the drawer slide structure of this invention showing the undersurface of the drawer.
Figure 6:
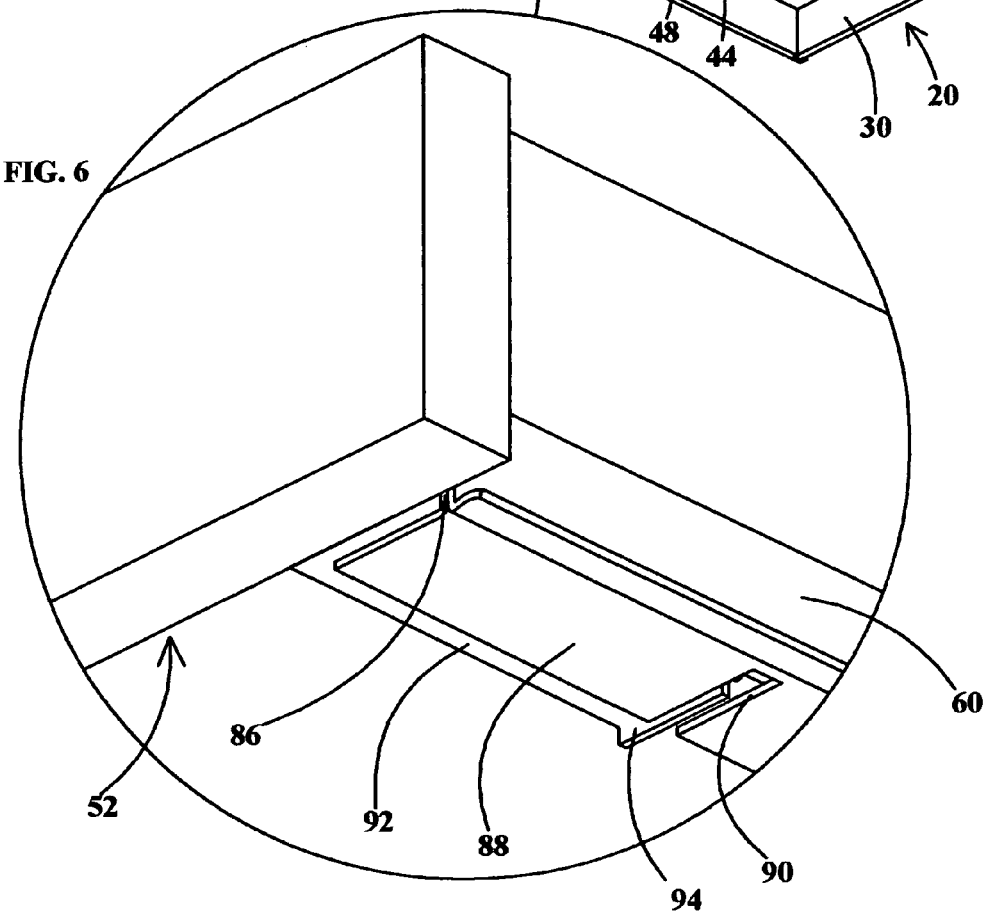
FIG. 6 is an enlarged isometric view of a portion of the drawer slide structure of this invention showing in more detail the drop in drawer feature of this invention where the drawer is engaged with the shelf on which it is mounted.
Figure 7:
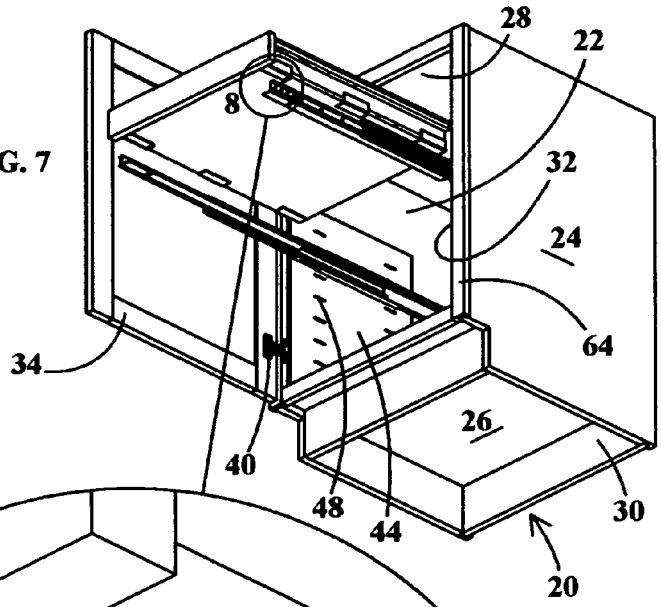
FIG. 7 is an enlarged view similar to FIG. 6 but where the drop drawer feature is not engaged with its shelf.
Figure 8:
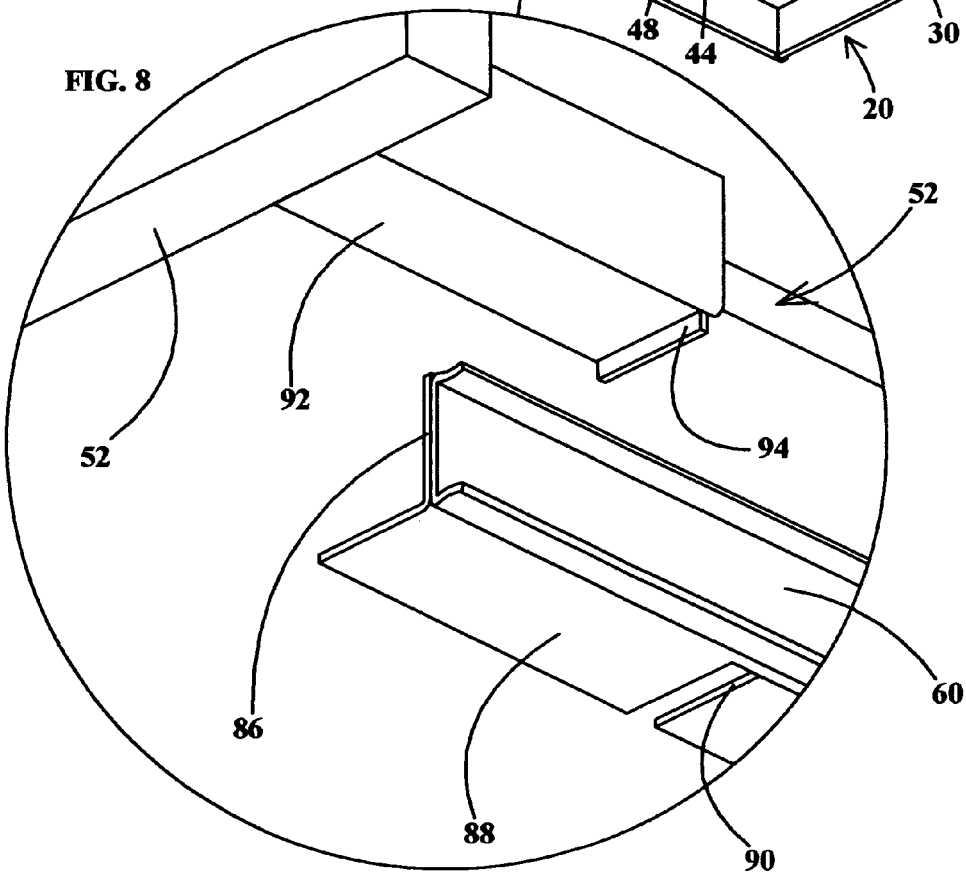
FIG. 8 is an enlarged isometric view of the drop drawer feature included within this invention showing the drop drawer feature not engaged with its shelf.
Figure 9:
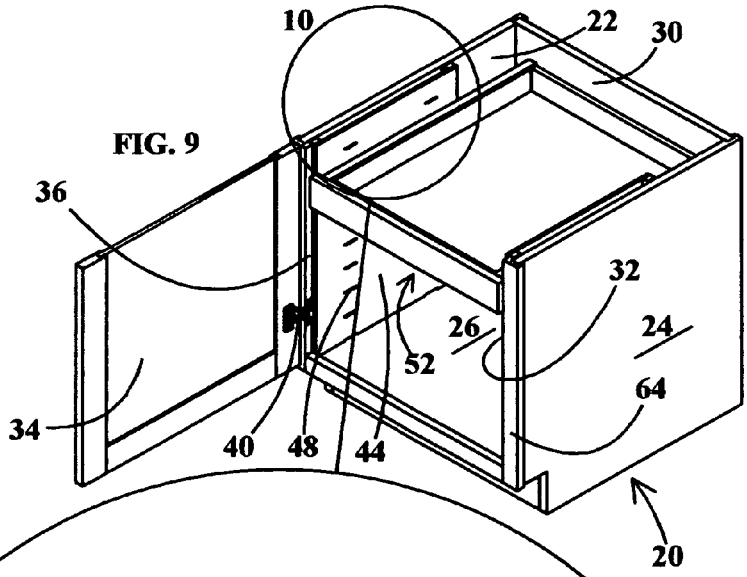
FIG. 9 is an isometric view similar to FIG. 1 but showing only a portion of the cabinet with the drawer retracted within the cabinet.
Figure 10:
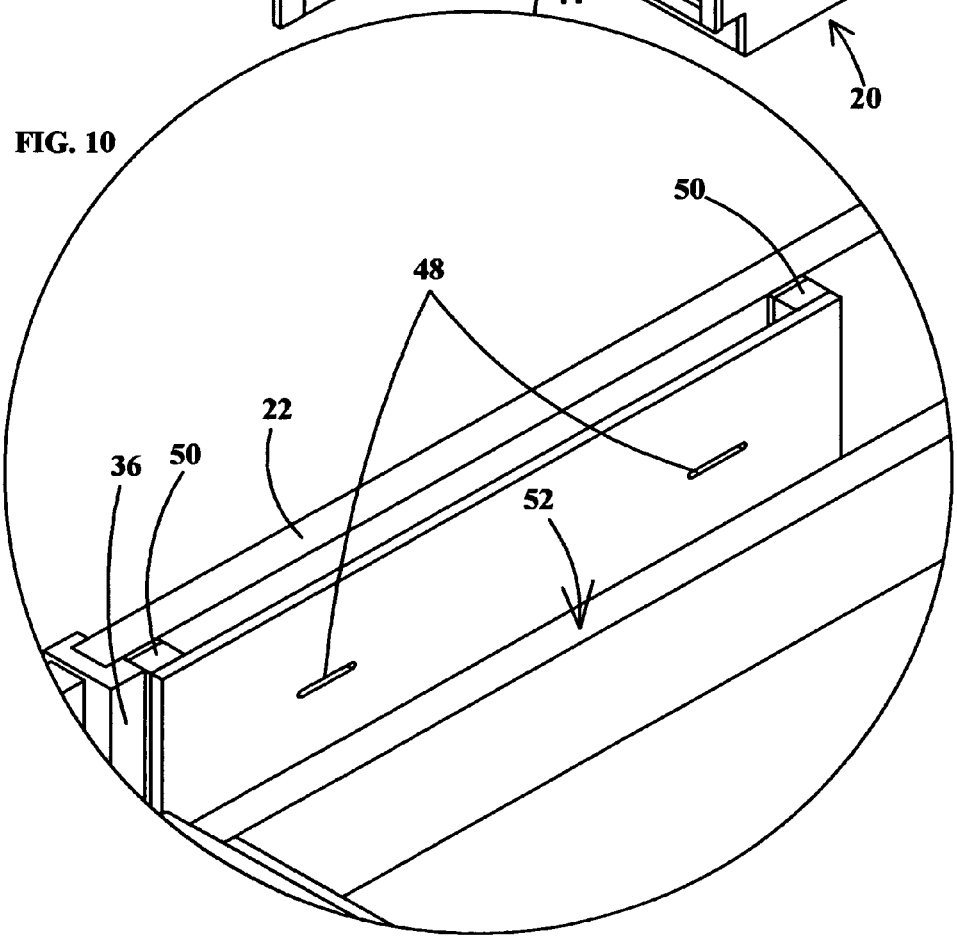
FIG. 10 is an enlarged isometric view showing the relationship between the grid panel and the drawer taken in area 10 of FIG. 9.

Fixedly secured to the outer surface of the cabinet member 58 of slide mechanism 54 are a pair of hanger tabs 76 with only one being shown. These hanger tabs are longitudinally spaced from each other a short distance equal to the distance between the front column of slots 48 and the rear column of slots 48. The hanger tabs 76 can be affixed by welding, riveting or any other permanent securement. Also the cabinet members 58 could be manufactured as a single piece with the hanger tabs 76. Additionally, the hanger tabs 76 could be mounted on a snap on bracket (not shown) which would just snap onto cabinet member 58. The hanger tabs 76 are in longitudinal alignment. Each hanger tab 76 has an upper free end 78 that is shown in FIG. 4 to have an arcuate shape having a concave top surface 80. This top surface 80 could be constructed to comprise two straight sections with a slight bend in the middle. The length of the free end 78 is just slightly greater than the thickness of grid panel 44 (see FIG. 4). The tip of the free end 78 will be located in the space between grid panel 44 and left sidewall 22 providing adequate clearance. The slot 48 has an upper surface 82 and a lower surface 84. The upper free end 78 of the hanger tabs are inserted within a pair of horizontally aligned slots 48. This is accomplished by slightly tilting of the cabinet member 58 so the free ends 78 will enter their respective slots 48. Once entered the cabinet member 58 is released which will cause such to pivot against the grid panel 44. At this position an interference fit 81 is produced between the upper surface 82 and upper free end 78 of hanger tab 76 (as shown in FIG. 4) and an interference fit 83 is produced between the upper free end 78 and lower surface 84. This binding action of the interference fits 81 and 83 securely locks in place the cabinet member 58 to grid panel 44. Accidental disengagement is prevented. However, the user can readily remove the drawer slide mechanism 54 and reconnect such to different slots 48 by merely tilting the drawer slide mechanism and removing the free ends 78 from their slots 48. Similar reconnecting will be done with slide mechanism 56 so the drawer 52 will be horizontal. Vertical adjustment of the slide mechanisms 54 and 56 is to vary the drawer space of drawer 52 which is part of the overall storage compartment 42. The preferable configuration for the free ends 78 is that of flat or plate like. Other configurations could work such as a rod.

Permanently attached to the outer surface of the drawer member is a right angled member that is composed of a leg 86 and a shelf 88. The right angled member comprises a single member. The leg is permanently attached to the drawer member as by welding or rivets. The shelf 88 is located horizontal. Shelf 88 includes a cut-out notch 90.

Fixed to the undersurface of drawer 52 at its right edge and left edge is a bracket 92. Bracket 92 is right angled and has a length of a few inches. There will normally be similar right angled brackets 92 installed along the depth of the drawer 52. These brackets 92 along one edge are to rest on the shelf 88 with the brackets 92 on the opposite edge also resting on a similar separate shelf 88. These brackets 92 insure that the drawer rests precisely horizontal. The brackets 92 that are located nearest the front of the drawer 52 each include a descending tab 94. The descending tab 94 is located at a right angle to the bracket 92. When the drawer 52 is installed to be supported by the shelves 88, the descending tab 94 on each side of the drawer 52 is to engage with a separate cut-out notch 90 thereby locking in place the drawer 52 to the slide mechanisms 54 and 56. However, the user can readily remove the drawer, if desired, by merely lifting the drawer 52 to disengage the descending tabs 94 from their respective cut-out notches 90. If the user wants to adjust the height location of the drawer 52 within the cabinet 20, he or she must first remove the drawer 52 from the slide mechanisms 54 and 56. The user then removes each slide mechanism 54 and 56 from their slots 48 and then moves such to different slots 48 and reinstall the slide mechanisms 54 and 56 within different slots 48. The user then replaces the drawer 52 in contact with the shelves 88 locating the descending tabs 94 within their respective cut-out notches 90.

Figure 11:
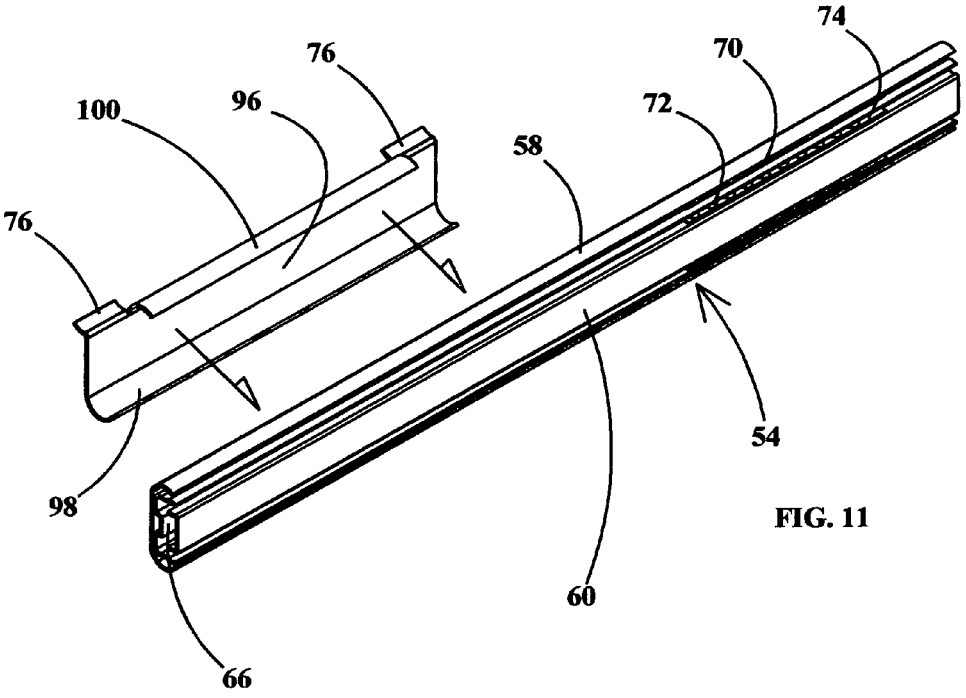
FIG. 11 is an isometric view of a modified form of mounting for the hanger tabs where the hanger tabs are mounted on a bracket that can be clipped onto the cabinet member of the slide mechanism.

Referring particularly to FIG. 11 there is shown a modified form of mounting for the hanger tabs 76. Instead of mounting the hanger tabs 76 directly onto the cabinet member 58 the hanger tabs 76 are integral with a clip bar or bracket 96. The bracket 96 has a channel defined as the space located between upper flange 100 and lower flange 98. The lower flange 98 is to be placed against the bottom edge of cabinet member 58 and then the upper flange 100 is then physically snapped over the top edge of cabinet member 58 which will install the slide mechanism 54 in the channel. There will be a separate bracket 96 used on the slide mechanism 56. This will securely attach the hanger tabs 76 to the cabinet member 58. This mounting arrangement will be most useful when utilizing an existing slide mechanism which doesn't have hanger tabs 76 mounted thereon.

The invention claimed is:

1. A drawer slide structure for installation in conjunction with side walls of a storage compartment of a cabinet, said drawer slide structure comprising:

a grid panel designed to be mounted by securing means to a side wall of the storage compartment, said grid panel having a plurality of identical slots, each slot of said slots having a height located between an upper surface and a lower surface;

a drawer slide mechanism having a drawer member and a cabinet member, said drawer member being longitudinally slideable relative to said cabinet member, said cabinet member having an outer flat wall from which protrudes outwardly a free end of a hanger tab, said free end having an upturned shape when viewed from the side, said free end having a concave top surface, said free end having a bottom surface, said free end to be insertable within one of said slots with a portion of said bottom surface forming an interference fit with said lower surface tightly engaging with said lower surface and said top surface forming an interference fit with a portion of said upper surface tightly engaging with said upper surface when said flat wall is located parallel to said grid panel, said free end of said hanger tab having a thickness of a fraction of said height of said slot; and whereby upon inserting said free end into one of said slots with said flat wall assuming an initial inclined position relative to said grid panel and then causing said flat wall to move to be parallel to said grid panel thereby locking said cabinet member to said grid panel by said interference fits.

2. The drawer slide structure as defined in claim 1 wherein:

said concave top surface defining a smoothly contoured area.

3. The drawer slide structure as defined in claim 1 wherein:

a pair of spaced apart hanger tabs connected to said cabinet member, said hanger tabs to connect with different said slots horizontally spaced from each other.

4. The drawer slide structure as defined in claim 2 wherein:

said smoothly contoured area having a radius of approximately one-half an inch, said height of said slot being approximately one-eighth of an inch, said free end of said hanger tab having a length in excess of one-fourth of an inch.

5. The drawer slide structure as defined in claim 1 wherein:

a drawer having a bottom on which is mounted a descending tab, said drawer member having a support shelf for supporting said drawer, a cut-out notch located within said support shelf, with said drawer connecting with said drawer member said descending tab interlocks with said cut-out notch thereby locking together said drawer and said drawer member, said drawer to be able to be manually moved to disengage said descending tab and said cut-out notch permitting separation of said drawer and said drawer member.

6. The drawer slide structure as defined in claim 1 wherein:

said securing means comprises a plurality of separate strips of double sided tape.

7. The drawer slide structure as defined in claim 1 wherein:

said hanger tab being mounted on a bracket, said bracket to be snapped onto said cabinet member securing said hanger tab to said cabinet member.

8. A method of installing a drawer in conjunction with sidewalls of a cabinet comprising the steps of:

utilizing a thin, sheet material grid panel of a selected shape which has a series of slots formed therein, the grid panel having an exterior surface and an interior surface, each slot of said slots having an upper surface and a lower surface;

mounting a plurality of double sided adhesive tape strips on said interior surface;

causing said tape strips to adhere to a sidewall of the storage compartment thereby securing in place said grid panel to said cabinet;

utilizing a drawer slide mechanism which has a drawer member and a cabinet member where said cabinet member has at least one hanger tab mounted thereon which extends outwardly from said cabinet member;

inserting said hanger tab into one of said slots causing said hanger tab to establish an interference fit with both said lower surface and said upper surface tightly engaging both said upper surface and said lower surface; and connecting and supporting a drawer on said drawer member.

9. The method as defined in claim 8 wherein the connecting step comprises:

utilizing a shelf attached to said cabinet member;

forming a cut-notch notch in said shelf;

locating a descending tab on the bottom of said drawer; and placing said descending within said cut-out notch securely interlocking said drawer and said drawer member.

* * * * *